US009453169B2

(12) United States Patent
Stippich, Jr. et al.

(10) Patent No.: US 9,453,169 B2
(45) Date of Patent: Sep. 27, 2016

(54) PROCESS FOR CONVERTING FISCHER-TROPSCH LIQUIDS AND WAXES INTO LUBRICANT BASE STOCK AND/OR TRANSPORTATION FUELS

(71) Applicant: UOP LLC, Des Plaines, IL (US)

(72) Inventors: Kenneth J. Stippich, Jr., Deer Park, IL (US); Vasant P. Thakkar, Elk Grove Village, IL (US); John A. Petri, Wauconda, IL (US)

(73) Assignee: UOP LLC, Des Plaines, IL (US)

( * ) Notice: Subject to any disclaimer, the term of this patent is extended or adjusted under 35 U.S.C. 154(b) by 321 days.

(21) Appl. No.: 14/026,658

(22) Filed: Sep. 13, 2013

(65) Prior Publication Data

US 2015/0076033 A1 Mar. 19, 2015

(51) Int. Cl.

| | |
|---|---|
| ***C10G 65/12*** | (2006.01) |
| ***C10G 45/58*** | (2006.01) |
| ***C10G 65/16*** | (2006.01) |

(52) U.S. Cl.

CPC ..... *C10G 65/12* (2013.01); *C10G 45/58* (2013.01); *C10G 65/16* (2013.01); *C10G 2300/1022* (2013.01); *C10G 2300/4081* (2013.01); *C10G 2400/10* (2013.01)

(58) Field of Classification Search

CPC ..... B01J 8/02; B01J 21/04; B01J 8/0005; C10G 65/12; C10G 45/58; C10G 65/16; C10G 2300/4081; C10G 2400/10; C10G 2300/1022

See application file for complete search history.

(56) References Cited

U.S. PATENT DOCUMENTS

| | | | |
|---|---|---|---|
| 5,378,348 | A | 1/1995 | Davis et al. |
| 6,774,272 | B2 | 8/2004 | Miller |
| 7,345,211 | B2 | 3/2008 | Espinoza et al. |
| 8,012,342 | B2 | 9/2011 | Kobayashi et al. |
| 8,216,448 | B2 | 7/2012 | Miller |
| 2004/0181110 | A1 | 9/2004 | Miller et al. |
| 2004/0232045 | A1 | 11/2004 | Simmons et al. |
| 2005/0236301 | A1* | 10/2005 | Adams ..... C10M 107/02 208/92 |
| 2006/0157384 | A1* | 7/2006 | Adams ..... C10G 2/32 208/49 |
| 2007/0187292 | A1 | 8/2007 | Miller et al. |
| 2011/0020190 | A1 | 1/2011 | Miller |
| 2011/0113676 | A1 | 5/2011 | Mackay et al. |
| 2012/0090223 | A1 | 4/2012 | Kokayeff et al. |
| 2012/0269695 | A1 | 10/2012 | Kokayeff |

OTHER PUBLICATIONS

Bouchy, "Fischer-Tropsch Waxes Upgrading via Hydrocracking and Selective Hydroisomerization" Oil & Gas Science and Technology—Rev. IFP, vol. 64 (2009), No. 1, pp. 91-112.

Kobayashi, "Branching Structure of Diesel and Lubricant Base Oils Prepared by Isomerization/Hydrocracking of Fischer-Tropsch Waxes and alpha-Olefins", Energy & Fuels 2009, 23, 513-518.

* cited by examiner

*Primary Examiner* — Randy Boyer
*Assistant Examiner* — Juan Valencia

(57) ABSTRACT

A process for converting Fischer-Tropsch liquids and waxes into lubricant base stock and/or transportation fuels is disclosed. The process includes the steps of feeding a Fischer-Tropsch wax to a first isomerization unit to produce an isomerized Fischer-Tropsch wax product; combining a Fischer-Tropsch liquid with the isomerized Fischer-Tropsch wax product to create a mixture of the Fischer-Tropsch liquid and the Fischer-Tropsch wax product; and feeding the mixture to a fractionation column to separate the mixture into a lubricant base stock fraction and at least one transportation fuel fraction.

7 Claims, 1 Drawing Sheet

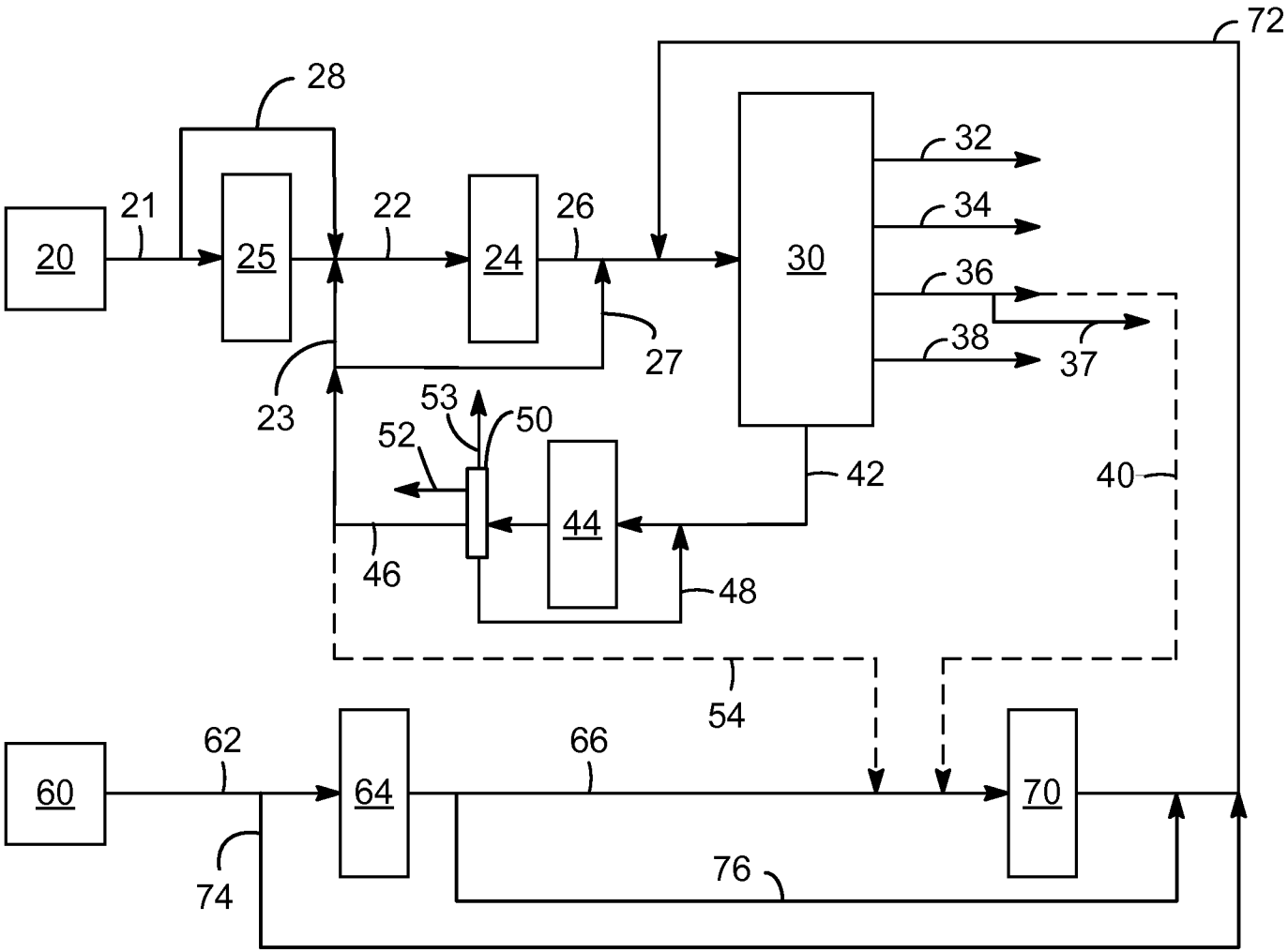
72
40
37
32
34
36
38
30
42
48
54
76
27
26
24
44
50
53
52
66
22
46
28
25
23
64
21
62
74
20
60
70

PROCESS FOR CONVERTING FISCHER-TROPSCH LIQUIDS AND WAXES INTO LUBRICANT BASE STOCK AND/OR TRANSPORTATION FUELS

BACKGROUND

The disclosure relates to a process for converting Fischer-Tropsch liquids and waxes into lubricant base stock and/or transportation fuels.

DESCRIPTION OF THE RELATED ART

Fischer-Tropsch synthesis is known to yield a broad mixture of products including primarily paraffins, and some olefins. The individual compounds of such mixture can contain up to about 200 carbons. Typically, the number of carbons is between about 20 and about 150, with an average number of carbons of about 60. Certain quantities of oxygenated products and trace amounts of sulfur-containing or nitrogen-containing products or aromatic compounds can be also present. There is significant economic incentive to convert Fischer-Tropsch (FT) wax to high quality lube base stocks, especially base oils with properties and performance comparable to, or better than, those of polyalphaolefins. The upgrading of Fischer-Tropsch wax greatly relies on advanced wax isomerization technology that transforms linear paraffins to multi-branched isoparaffins with minimal cracking. It remains a great challenge to effectively convert Fischer-Tropsch waxes to high quality lube base stocks.

Some Fischer-Tropsch processes yield mixtures enriched with $C_5$-$C_{30}$ alkanes and also containing a significant quantity of olefins and oxygenated compounds such as alcohols or acids. Such mixtures are known as "light Fischer-Tropsch liquids" or "LFTL." Light Fischer-Tropsch liquids are frequently used as a raw material for obtaining various petrochemical products, such as, e.g., petroleum distillates, or diesel fuels, among others. To make LFTL useful and suitable as blending stock for diesel fuel, olefins and oxygenated compounds contained therein are removed, typically by the saturation of olefins and by conversion of oxygenated compounds into water via hydrogenation also known as hydrotreating, which involves the processes of hydrogenation of LFTL in the presence of hydrogen and a catalyst.

The presently-available processes for hydrotreating of LFTL are characterized by producing a final product having relatively poor cold flow properties such as high cloud point and cold filter plugging point (CFPP). These poor cold flow properties limit the amount of the product that can be blended into diesel fuels.

Recently, there has been much interest in synthesizing Fischer-Tropsch compounds from biomass as a renewable resource. For example, Fischer-Tropsch liquids and waxes are readily available from Fischer-Tropsch processes using biomass.

Therefore, what is needed is an improved process for converting Fischer-Tropsch liquids and waxes into lubricant base stock and/or transportation fuels.

SUMMARY

The foregoing needs are met by process for converting Fischer-Tropsch liquids and waxes into lubricant base stock and/or transportation fuels.

This invention provides a process configuration to convert low value intermediate Fischer-Tropsch liquids and waxes obtained from biomass and potentially other renewable and non renewable feed sources into high value lube base oils and transportation fuels. The process configuration can be a combination of hydrotreating and hydrocracking processes and two hydroisomerization processes. It may be possible to combine the recycle gas system for all four hydroprocessing processes as well as combine all or most of the individual unit fractionation services.

Fischer-Tropsch wax is processed in a wax isomerization process to produce lube oil base stock with improved cold flow properties by isomerizing long chain waxy paraffinic molecules. This material is separated into the desired lube cuts in a fractionation section. In the event that some of the material is too heavy for use as a desired product, a bottoms cut from the fractionation section is sent to a hydrocracking process unit to reduce the boiling range of the material. The hydrocracker effluent may then be recycled to the wax isomerization process or sent directly to the fractionation section.

These and other features, aspects, and advantages of the present invention will become better understood upon consideration of the following detailed description, drawings and appended claims.

BRIEF DESCRIPTION OF THE DRAWING

The FIGURE is a schematic process flow diagram of a process for converting Fischer-Tropsch liquids and waxes into lubricant base stock and/or transportation fuels according to the invention.

DETAILED DESCRIPTION

As used herein, the term "unit" can refer to an area including one or more equipment items and/or one or more sub-zones. Equipment items can include one or more reactors or reactor vessels, heaters, exchangers, pipes, pumps, compressors, vessels for separation and controllers. Additionally, an equipment item, such as a reactor, dryer, or vessel, can further include one or more zones or sub-zones.

The term "downstream communication" means that at least a portion of material flowing to the subject in downstream communication may operatively flow from the object with which it communicates.

The term "upstream communication" means that at least a portion of the material flowing from the subject in upstream communication may operatively flow to the object with which it communicates.

The term "direct communication" means that flow from the upstream component enters the downstream component without undergoing a compositional change due to physical fractionation or chemical conversion.

The term "column" means a distillation column or columns for separating one or more components of different volatilities.

The term "hydrocarbon" is defined as an organic compound, the molecule of which consists only of carbon and hydrogen.

The terms "paraffin" and "alkane" are used interchangeably and refer to a hydrocarbon identified by saturated carbon chains, which can be normal (straight), or branched, and described by a general formula $C_nH_{2n+2}$, where n is an integer. Paraffins or alkanes are substantially free of carbon-carbon double bonds (C═C).

The term "olefin," also known as "alkene" is defined as a hydrocarbon containing at least one carbon-carbon double bond, and described by a general formula $C_nH_{2n}$, where n is an integer.

The term "catalyst" is defined as substance that changes the speed or yield of a chemical reaction without being itself substantially consumed or otherwise chemically changed in the process.

The term "light Fischer-Tropsch liquid" or the abbreviation "LFTL" is defined as a mixture comprised of n-paraffins having the number of carbons between about 5 and about 50, the mixture containing a substantial portion of $C_5$-$C_{30}$ alkanes and may also contain olefins and oxygenated compounds. A Fischer-Tropsch synthesis typically produces liquid streams from a series of flashes. One such example is a Fischer-Tropsch synthesis process that produces a stream that is primarily in the naphtha boiling range, a mid-distillate stream and a stream heavier than mid-distillate, which is usually referred to as wax. The two lighter streams may be referred to as light Fischer-Tropsch liquids (LFTL). The flashed liquids are typically stripped to remove light ends, such as entrained synthesis gas and $C_4$-hydrocarbons.

The term "hydrotreat" generally refers to the saturation of double bonds and removal of heteroatoms (oxygen, sulfur, nitrogen and metals) from heteroatomic compounds. Typically, to "hydrotreat" means to treat a hydrocarbon stream with hydrogen without making any substantial change to the carbon backbone of the molecules in the hydrocarbon stream with the corresponding production of water, hydrogen sulfide and ammonia from the heteroatoms in the heteroatomic compounds. Oxygenated components of the FT liquids may contain organic acids that chemically dissolve the metals in the FT synthesis catalyst. The dissolved metals are reacted by the hydrotreating catalyst system and deposited onto the hydrotreating catalyst.

The term "isomerize" means to convert at least a portion of hydrocarbons to more branched hydrocarbons typically in the presence of hydrogen. An example of isomerization comprises the conversion of linear paraffins into isoparaffins. Another example of isomerization comprises the conversion of mono-branched paraffins into di-branched paraffins.

The term "hydrocrack" generally refers to the breaking down of high molecular weight material into lower molecular weight material in the presence of hydrogen gas and typically in the presence of a catalyst. For example, to "hydrocrack" means to split a hydrocarbon to form two hydrocarbon molecules of lower molecular weight.

The term "wax" when used in this disclosure refers to a synthetic hydrocarbon wax and is typically obtained as the highest boiling fraction or one of the highest boiling fractions from a Fischer-Tropsch derived product. The synthetic hydrocarbon wax is most often a solid at room temperature. For the purpose of this disclosure, the synthetic hydrocarbon wax includes a $C_{20+}$ wax, suitably a $C_{20}$-$C_{150}$ hydrocarbonaceous compounds with a boiling point typically greater than 340° C., more preferably, a Fischer-Tropsch (FT) $C_{20}$-$C_{45}$ wax. The term "naphtha" when used in this disclosure refers to a liquid product having between $C_4$ and $C_{12}$ carbon atoms in the backbone and will have a boiling range generally below that of diesel, but wherein the upper end of the boiling range could overlap that of the initial boiling point of diesel.

The term "jet fuel" is any hydrocarbon cut having at least a portion that boils within the jet fuel boiling range. The jet fuel range includes $C_6$ to $C_{16}$ hydrocarbons that boil in the range of about 120° to about 290° C. (about 250° to about 550° F.), preferably in the range of about 120° to about 260° C. (about 250° to about 500° F.). The jet fuel may contain hydrocarbons boiling above or below the jet fuel range to the extent that such additional hydrocarbons allow the jet fuel to meet desired jet fuel specifications. One example jet fuel is JP-8, a kerosene-based fuel which is specified and used widely by the U.S. military. It is specified by MIL-DTL-83133, and similar to commercial aviation's Jet-A or Jet-A1. Another example jet fuel is synthetic paraffinic kerosene, or "SPK" that is specified in ASTM 7566.

The term "diesel fuel" is defined as a product that meets specifications such as those described in the ASTM Specification D975 and refers to a petroleum fraction having containing primarily $C_9$-$C_{24}$ hydrocarbons and having ASTM D86 distillation temperatures of about 160° C. (320° F.), at the 10% recovery point and about 340° C. (644° F.) at the ASTM D86 90% recovery point. In another example of diesel fuel is a product that meets European Union specifications or other governments' specifications for diesel fuel that typically encompass specified flash points, ASTM D86 T90% to T95% points, cetane number, cetane indices and other properties pertinent for producing a fungible fuel for diesel engines.

The term "kerosene" refers to a $C_6$ to $C_{16}$ hydrocarbon which boils in the range from about 85° C. (185° F.) to about 332° C. (630° F.).

The term "lubricant base stock" or "lube base stock" is defined in accordance with the American Petroleum Institute, which has defined a base stock "as a lubricant component that is produced by a single manufacturer to the same specifications (independent of feed source or manufacturer's location); that meets the same manufacturer's specification; and that is identified by a unique formula, product identification number or both". A base oil is defined as "the base stock or blend of base stocks used in an API licensed oil". Although they are referenced for other applications, API base stock applications apply mainly to components used in engine oils. Base stocks are classified into two broad types, naphthenic and paraffinic, depending on the crude types from which they are derived. Paraffinic crudes contain wax, comprising largely n- and iso-paraffins which have high melting points. One non-limiting example lubricant base stock includes a $C_{20}$-$C_{45}$ n-paraffin and iso-paraffin wax having a kinematic viscosity at 100° C. in the range of 1 to 20 centistokes (cSt).

Turning to the FIGURE, a schematic process flow diagram for converting Fischer-Tropsch waxes and liquids into lubricant base stock and/or transportation fuels according to example embodiments of the present invention is depicted. As shown in the FIGURE, Fischer-Tropsch waxes 20 and liquids 60 are provided. Fischer-Tropsch waxes 20 and liquids 60 may be obtained from any suitable source. For example, in one embodiment, Fischer-Tropsch waxes 20 and liquids 60 may be purchased directly from commercial sources. In one embodiment, Fischer-Tropsch waxes 20 and liquids 60 may be obtained from biomass and other renewable or non-renewable feed sources. Preferably, Fischer-Tropsch waxes 20 and liquids 60 may be obtained from biomass, e.g., forest biomass, or related renewable feed sources. The Fischer-Tropsch liquids 60 may be light Fischer-Tropsch liquids.

As shown in the FIGURE, a Fischer-Tropsch wax 20 is fed to a first isomerization unit 24 through a conduit 22. In one embodiment, the conduit 22 may also include means for combining low value lubes and other intermediates produced in the system with Fischer-Tropsch wax 20 for recycling.

In one preferred embodiment, Fischer-Tropsch wax 20 may be processed before it is fed to the first isomerization unit 24. For example, the Fischer-Tropsch wax 20 may be hydrotreated before it is fed to the first isomerization unit 24. As shown in the FIGURE, Fischer-Tropsch wax 20 may be fed to a first hydrotreating unit 25 through a conduit 21 to produce a hydrotreated Fischer-Tropsch wax product. The first hydrotreating unit 25 may be any suitable hydrotreating unit. Preferably, the first hydrotreating unit 25 may be any hydrotreating unit using hydroprocessing technologies to remove oxygenates, organic sulfur and nitrogen, FT synthesis catalyst fines and dissolved metals, and saturate olefins in Fischer-Tropsch wax 20. More preferably, the first hydrotreating unit 25 may be a UOP FT Unionfining unit. Detailed information on a UOP FT Unionfining unit has been described in Petri et al., "Enabling Increased Production of Diesel", Catalysis 2011 (www.digitalrefining.com/article/1000409). It is also contemplated that the Fischer-Tropsch wax 20 in line 21 may bypass the hydrotreating unit 25 in line 28.

The Fischer-Tropsch wax 20 may include chemical contaminants such as oxygenates and olefins during its production through a typical process, e.g., an FT synthesis route. The Fischer-Tropsch wax 20 may or may not contain sulfur or nitrogen-containing heteroatoms such as dibenzothiophenes or carbazoles typically found in similar boiling crude fractions. For FT synthesis routes based on slurry reactors, catalyst fines may also carry over into wax and even possibly into the LFTL products. The concentration of oxygenates and olefins and the types of oxygenates are highly dependent on the catalyst type and operating conditions in the FT synthesis reactor. Certain types of oxygenates can dissolve metals from the FT synthesis reactor system catalyst into the wax. All of these factors lead to a wide variation in the LFTL chemical properties. These chemical contaminants and catalyst fines and dissolved metals may have negative effects on the downstream process and the final products. A hydrotreating unit, such as the first hydrotreating unit 25, is capable of eliminating at least some of these chemical contaminants and FT synthesis catalyst fines and dissolved metals.

For example, in one typical first hydrotreating unit 25, one may consider the bulk and chemical properties of Fischer-Tropsch wax 20 as one of the standards in the mechanical design of the unit and the design of the catalyst system. The catalyst system in one typical FT first hydrotreating unit 25 may include filtration media such as the reticulated ceramic media technology to capture the fines and mitigate pressure drop over the catalyst cycle length. Active catalysts may be selected to react the dissolved metals, saturate the olefins and convert oxygenates to water. The dissolved metals that are reacted by the catalyst system are deposited onto the active catalysts. The wide range of chemical properties of Fischer-Tropsch wax 20 may be accommodated by the appropriate selection of various catalysts and operating conditions in the first hydrotreating unit 25, to achieve the processing objectives and the desired catalyst cycle length. Consequently, after hydrotreating the Fischer-Tropsch wax 20, the stabilized products are almost exclusively normal paraffins.

The Fischer-Tropsch wax 20, either hydrotreated or not hydrotreated, is fed to the first isomerization unit 24 in conduit 22. The first isomerization unit 24 may include any suitable isomerization unit which converts at least a portion of hydrocarbons in the Fischer-Tropsch wax 20 to more branched hydrocarbons as isomerized Fischer-Tropsch wax products, such as lubricant base stocks and/or transportation fuels. For example, a suitable first isomerization unit 24 may include any units which convert the Fischer-Tropsch wax 20 into high value lubes to produce Group II or Group III base oils, or to make blendstocks. The suitable first isomerization unit 24 may also be capable of processing a wide variety of waxes. The suitable first isomerization unit 24 may not only isomerize low value slack waxes and oils into higher valued lubes, but also produce valuable by-products from hydrocracking a portion of the wax into gasoline and diesels without the need for further processing. The suitable first isomerization unit 24 may include any catalytic dewaxing units or hydroisomerization units or others well known to those skilled in the art.

Specifically in the isomerization unit 24, wax may be liquefied and preheated to a temperature required to perform isomerization reactions and fed to a fixed bed reactor containing a catalyst selective for performing isomerization.

While virtually any isomerization catalyst may be satisfactory for this step, some catalysts perform better than others and are preferred. For example, catalysts containing a supported Group VIII noble metal, e.g., platinum or palladium, are useful as are catalysts containing one or more Group VIII base metals, e.g., nickel, cobalt, which may or may not also include a Group VI metal, e.g., molybdenum or tungsten. The support for the metals can be any refractory oxide or zeolite or mixtures thereof. Preferred supports include silica, alumina, titania, zirconia, vanadia and other Group III, IV, VA or VI oxides, as well as Y sieves, such as ultrastable Y sieves. Preferred supports include alumina and silica-alumina where the silica concentration of the bulk support is less than about 50 wt %, preferably less than about 35 wt %. SAPO and MAPSO supports may also be suitable. More preferred supports are those described in U.S. Pat. No. 5,187,138. Briefly, the catalysts described therein contain one or more Group VIII metals on alumina or silica-alumina supports where the surface of the support is modified by the addition of a silica precursor, e.g., $Si(OC_2H_5)_4$. Silica addition is at least 0.5 wt % preferably at least 2 wt %, more preferably about 2-25 wt %.

Isomerization temperatures can range from about 149° to about 427° C. (300° to about 800° F.), preferably about 343° to about 399° C. (650° to about 750° F.), a pressure of about 0 to about 172 bar (2500 psig), preferably about 3447 to about 8274 kPa (500 to about 1200 psig) and a hydrogen treat rate of about 85 to about 850 Nm3/m3 (500 to about 5000 SCF/B), preferably about 340 to about 675 Nm3/m3 (2000 to about 4000 SCF/B) and a hydrogen consumption rate of about 8 to about 85 Nm3/m3 (50 to about 500 SCF/B), preferably about 17 to about 51 Nm3/m3 (100 to about 300 SCF/B).

Paraffinic molecules in wax feed are either isomerized by a catalyst to branched lower pour point lube molecules or converted to lower boiling gasoline and diesel fractions of transportation fuels. In a typical isomerization unit 24, the reactor internals may promote even distribution of reactants and prevent hot spots and unnecessary cracking. Therefore, Groups I, II and III base oils may be easily achieved with fuels processing flexibility from the same unit, depending on refining economics.

As shown in the FIGURE, after isomerized Fischer-Tropsch wax products are produced, a Fischer-Tropsch liquid 60 may be combined with the isomerized Fischer-Tropsch wax product via line 72 to create a mixture of the Fischer-Tropsch liquid and the Fischer-Tropsch wax product. In one embodiment, the Fischer-Tropsch liquid 60 may or may not be further processed before it is combined with the isomerized Fischer-Tropsch wax product.

In one preferred embodiment, Fischer-Tropsch liquid 60 may be processed before it is combined with the isomerized Fischer-Tropsch wax product. For example, the Fischer-Tropsch liquid 60 may be hydrotreated and/or isomerized before it is combined with the isomerized Fischer-Tropsch wax product. As shown in the FIGURE, Fischer-Tropsch liquid 60 may be fed to a second hydrotreating unit 64 through a conduit 62 to produce a hydrotreated Fischer-Tropsch liquid product. The second hydrotreating unit 64 may be any suitable hydrotreating unit as previously described for the first hydrotreating unit 25. Preferably, the second hydrotreating unit 64 may be any hydrotreating unit using hydroprocessing technologies to remove oxygenates, organic sulfur and nitrogen, FT synthesis catalyst fines and dissolved metals, and saturate olefins in Fischer-Tropsch liquid 60. The Fischer-Tropsch liquid 60 may include chemical contaminants such as oxygenates and olefins during its production through a typical process, e.g., an FT synthesis route. The Fischer-Tropsch liquid 60 may or may not contain sulfur or nitrogen-containing heteroatoms such as dibenzothiophenes or carbazoles typically found in similar boiling crude fractions. For FT synthesis routes based on slurry reactors, catalyst fines may also carry over into wax and even possibly into the LFTL products. The concentration of oxygenates and olefins and the types of oxygenates are highly dependent on the catalyst type and operating conditions in the FT synthesis reactor. Certain types of oxygenates can dissolve metals from the reactor system into the LFTL. All of these factors lead to a wide variation in the LFTL chemical properties. These chemical contaminants and catalyst fine metals may have negative effects on the further process and the final products. A hydrotreating unit, such as the second hydrotreating unit 64, is capable of eliminating at least some of these chemical contaminants and Fischer-Tropsch synthesis catalyst fines and dissolved metals.

For example, in one typical FT Unionfining Process, one may consider the bulk and chemical properties of Fischer-Tropsch liquid 60 as one of the standards in the mechanical design of the unit and the design of the catalyst system. The catalyst system in one typical FT second hydrotreating unit 64 may include filtration media such as the reticulated ceramic media technology to capture the fines and mitigate pressure drop over the catalyst cycle length. Active catalysts may be selected to react the dissolved metals, saturate the olefins and convert oxygenates to water. The dissolved metals that are reacted by the catalyst system are deposited onto the active catalysts. The wide range of chemical properties of Fischer-Tropsch liquid 60 may be accommodated by the appropriate selection of various catalysts and operating conditions in the second hydrotreating unit 64, to achieve the processing objectives and the desired catalyst cycle length. Consequently, after hydrotreating the Fischer-Tropsch liquid 60, the stabilized products are almost exclusively normal paraffins.

In an embodiment, conduit 74 is in downstream communication with conduit 62 and in upstream communication with conduit 72 and conduit 26. The conduit 74 bypasses Fischer-Tropsch liquid 60 around the second hydrotreating unit 64 and the second isomerization unit 70 to mix Fischer-Tropsch liquid with isomerized Fischer-Tropsch wax in line 26. The mixture of Fischer-Tropsch liquid and isomerized Fischer-Tropsch wax may then be fractionated in column 30.

Returning to the preferred embodiment, after the hydrotreated Fischer-Tropsch liquid product is produced, the hydrotreated Fischer-Tropsch liquid product is fed to a second isomerization unit 70 through a conduit 66 to produce an isomerized Fischer-Tropsch liquid product. In one specific embodiment, the conduit 66 may further include means for combining kerosene, diesel and/or light lubes from other processes. In one preferred embodiment, the kerosene, diesel and/or light lubes may be produced from a treatment process of the Fischer-Tropsch wax 20 such as from line 40 and/or 54.

As explained with respect to the first isomerization unit 24, the second isomerization unit 70 may include any suitable isomerization unit which converts at least a portion of hydrocarbons in the hydrotreated Fischer-Tropsch liquid products to more branched hydrocarbons as isomerized Fischer-Tropsch liquid products, such as lubricant base stocks and/or transportation fuels.

As shown in the FIGURE, after the isomerized Fischer-Tropsch liquid product is produced from the second isomerization unit 70, the isomerized Fischer-Tropsch liquid product is transported in a conduit 72. As the conduit 72 is in fluid communication with the conduit 26, the isomerized Fischer-Tropsch liquid product is transported to combine with the isomerized Fischer-Tropsch wax product to produce a mixture of the isomerized Fischer-Tropsch wax and liquid products.

In a further embodiment, conduit 76 is in downstream communication with conduit 66 and in upstream communication with conduit 72 and conduit 26. The conduit 76 bypasses hydrotreated Fischer-Tropsch liquid from the second hydrotreating unit 64 around the second isomerization unit 70 to mix Fischer-Tropsch liquid with isomerized Fischer-Tropsch wax in line 26. The mixture of hydrotreated Fischer-Tropsch liquid and isomerized Fischer-Tropsch wax may then be fractionated in column 30.

As shown in the FIGURE, after the mixture, e.g., a mixture of an isomerized Fischer-Tropsch wax product and a Fischer-Tropsch liquid or a mixture of isomerized Fischer-Tropsch wax and liquid products, is obtained, the mixture is fed to a fractionation column 30 to separate the mixture into a lubricant base stock fraction and at least one transportation fuel fraction. Column 30 may include any suitable fractionation column known to a person having ordinary skill in the art. In another embodiment 30 may include one or more fractionation columns. One such example of this embodiment may be an distillation column operating at near atmospheric pressure and another distillation column that operates at a sub-atmospheric pressure or at a vacuum pressure. Depending on the boiling points, different fractions of lubricant base stocks and/or transportation fuels may be produced. In one specific embodiment, the as-produced products may comprise a fraction of naphtha and related compounds from outlet 32. In another specific embodiment, the as-produced transportation fuels may comprise a fraction of jet fuel from outlet 34. In one preferred embodiment, the jet fuel may comprise JP-8. In another specific embodiment, the as-produced transportation fuels may comprise a fraction of diesel from outlet 36. In yet another specific embodiment, the as-produced lubricant base stocks may comprise $C_{20}$-$C_{45}$ n-paraffin and iso-paraffin wax having a kinematic viscosity at 100° C. in the range of 1 to 20 centistokes (cSt), preferably 2-12 centistokes (cSt) from outlet 38. Preferably, one may wish to produce fractions of lubricant base stocks having a controllable range of kinematic viscosities using the present invention. Applicants envision that fractions of lubricant base stocks having a controllable range of kinematic viscosities may be useful feed stocks for various processes and techniques. For example, fractions of lubricant base stocks having kinematic viscosity at 100° C. in the range of 2-12 centistokes (cSt) are commercially important feedstocks for making transportation fuels.

In one embodiment, the mixture of an isomerized Fischer-Tropsch wax product and a Fischer-Tropsch liquid or a mixture of isomerized Fischer-Tropsch wax and liquid products may be separated into a second fraction of lubricant base stock, and the second fraction of lubricant base stock may comprise lubricant base stocks having kinematic viscosity at 100° C. larger than 7 centistokes, preferably larger than 12 centistokes (cSt). As shown in the FIGURE, the second fraction of lubricant base stock is fed to the fractionation column 30 along with the mixture. Specifically, the second fraction of lubricant base stock is fed to a hydrocracking unit 44 through a conduit 42. The hydrocracking unit 44 may include any suitable units for breaking down of high molecular weight material in the second fraction of lubricant base stock into lower molecular weight materials in the presence of hydrogen gas and typically in the presence of a catalyst. In one preferred embodiment, the hydrocracking unit 44 may include a unit using a hydrocracking technology, e.g., UOP Unicracking Process, to convert higher molecular weight paraffins selectively to lower molecular weight isomerized hydrocarbons for fuels-range products such as diesel and jet fuel.

Hydrocracking may be performed in the hydrocracking unit 44 with hydrocracking catalysts that utilize amorphous silica-alumina bases or low-level zeolite bases combined with one or more Group VIII or Group VIB metal hydrogenating components.

The zeolite cracking bases are sometimes referred to in the art as molecular sieves and are usually composed of silica, alumina and one or more exchangeable cations such as sodium, magnesium, calcium, rare earth metals, etc. They are further characterized by crystal pores of relatively uniform diameter between about 4 and about 14 Angstroms ($10^{-10}$ meters). It is preferred to employ zeolites having a relatively high silica/alumina mole ratio between about 3 and about 12. Suitable zeolites found in nature include, for example, mordenite, stilbite, heulandite, ferrierite, dachiardite, chabazite, erionite and faujasite. Suitable synthetic zeolites include, for example, the B, X, Y and L crystal types, e.g., synthetic faujasite and mordenite. The preferred zeolites are those having crystal pore diameters between about 8 and 12 Angstroms ($10^{-10}$ meters), wherein the silica/alumina mole ratio is about 4 to 6. One example of a zeolite falling in the preferred group is synthetic Y molecular sieve.

The naturally occurring zeolites are normally found in a sodium form, an alkaline earth metal form, or mixed forms. The synthetic zeolites are nearly always prepared first in the sodium form. In any case, for use as a cracking base it is preferred that most or all of the original zeolitic monovalent metals be ion-exchanged with a polyvalent metal and/or with an ammonium salt followed by heating to decompose the ammonium ions associated with the zeolite, leaving in their place hydrogen ions and/or exchange sites which have actually been decationized by further removal of water. Hydrogen or "decationized" Y zeolites of this nature are more particularly described in U.S. Pat. No. 3,130,006.

Mixed polyvalent metal-hydrogen zeolites may be prepared by ion-exchanging first with an ammonium salt, then partially back exchanging with a polyvalent metal salt and then calcining. In some cases, as in the case of synthetic mordenite, the hydrogen forms can be prepared by direct acid treatment of the alkali metal zeolites. In one aspect, the preferred cracking bases are those which are at least about 10 percent, and preferably at least about 20 percent, metal-cation-deficient, based on the initial ion-exchange capacity. In another aspect, a desirable and stable class of zeolites is one wherein at least about 20 percent of the ion exchange capacity is satisfied by hydrogen ions.

The active metals employed in the preferred hydrocracking catalysts of the present invention as hydrogenation components are those of Group VIII, i.e., iron, cobalt, nickel, ruthenium, rhodium, palladium, osmium, iridium and platinum. In addition to these metals, other promoters may also be employed in conjunction therewith, including the metals of Group VIB, e.g., molybdenum and tungsten. The amount of hydrogenating metal in the catalyst can vary within wide ranges. Broadly speaking, any amount between about 0.05 percent and about 30 percent by weight may be used. In the case of the noble metals, it is normally preferred to use about 0.05 to about 2 wt %.

By one approach, the hydrocracking conditions may include a temperature from about 290° C. (550° F.) to about 468° C. (875° F.), preferably 343° C. (650° F.) to about 435° C. (815° F.), a pressure from about 3.5 MPa (500 psig) to about 20.7 MPa (3000 psig), a liquid hourly space velocity (LHSV) from about 0.5 to less than about 5.0 $hr^{-1}$ and a hydrogen rate of about 421 $Nm^3/m^3$ oil (2,500 scf/bbl) to about 2,527 $Nm^3/m^3$ oil (15,000 scf/bbl). If mild hydrocracking is desired, conditions may include a temperature from about 315° C. (600° F.) to about 441° C. (825° F.), a pressure from about 3.5 MPa (gauge) (500 psig) to about 13.8 MPa (gauge) (2000 psig) or more typically about 4.8 MPa (gauge) (700 psig) to about 8.3 MPa (gauge) (1200 psig), a liquid hourly space velocity (LHSV) from about 0.5 to about 5.0 $hr^{-1}$ and preferably about 0.7 to about 1.5 $hr^{-1}$ and a hydrogen rate of about 421 $Nm^3/m^3$ oil (2,500 scf/bbl) to about 1,685 $Nm^3/m^3$ oil (10,000 scf/bbl).

In one embodiment, lubricant base stock produced from the hydrocracking unit 44 may be fractionated in column 50. An unconverted oil fraction of lubricant base stock may recycled from the column 50 back to the hydrocracking unit for further hydrocracking. Hydrocracked products such as diesel and naphtha may be collected from the column 50 in conduits 52 and 53, respectively. As shown in the FIGURE, this unconverted oil fraction of lubricant base stock is recycled through a conduit 48.

In one embodiment, a fraction of lubricant base stock from the hydrocracking unit 44 may be directly combined with the mixture of an isomerized Fischer-Tropsch wax product and a Fischer-Tropsch liquid or a mixture of isomerized Fischer-Tropsch wax and liquid products. As shown in the FIGURE, this fraction of lubricant base stock is transported in a conduit 46. The conduit 46 may be in fluid communication with the conduit 22 via conduit 23. In another embodiment, the fraction of lubricant base stock produced from the hydrocracking unit 44 may be combined with the Fischer-Tropsch wax 20 perhaps after hydrotreating in the first hydrotreating unit 25 if used. As shown in the FIGURE, the conduit 46 may be in fluid communication with the conduit 26, so that the fraction of lubricant base stock produced from the hydrocracking unit 44 bypasses the first isomerization unit 24 via conduit 27 and is mixed with Fischer-Tropsch wax 20 that may or may not have been hydrotreated in hydrotreating unit 25.

In another embodiment, the fraction of lubricant base stock produced from the hydrocracking unit 44 may be combined with the hydrotreated Fischer-Tropsch liquid products. As shown in the FIGURE, this fraction of lubricant base stock is transported in the conduit 46. The conduit 46 is in fluid communication with a conduit 54, and the conduit 54 is in fluid communication with the conduit 66.

In another embodiment, the present invention may also include a further step for processing the as-separated fractions of transportation fuels, e.g., diesel. For example, the as-separated diesel fraction from outlet 36 may be combined with the hydrotreated Fischer-Tropsch liquid products for further isomerization. As shown in the FIGURE, the diesel fraction from outlet 36 is transported in a conduit 40. As the conduit 40 is in fluid communication with the conduit 66, the diesel fraction from outlet 36 is combined with the hydrotreated Fischer-Tropsch liquid products for further isomerization in the second isomerization unit 70. Diesel product may be recovered in conduit 37.

In another aspect, the present invention relates to various apparatuses for converting Fischer-Tropsch liquids and waxes into lubricant base stock and/or transportation fuels by using any of the processes as discussed above.

In one embodiment of the apparatus, the apparatus comprises the source of Fischer-Tropsch wax 20 in upstream communication with the conduit 22; the first isomerization unit 24 in downstream communication with the conduit 22 and upstream communication with the conduit 26; the fractionation column 30 in downstream communication with the conduit 26; and the source of Fischer-Tropsch liquid 60 in upstream communication with the conduit 26.

In another embodiment of the apparatus, the apparatus further comprises conduit 42 in downstream communication with the fractionation column 30; the hydrocracking unit 44 in downstream communication with the conduit 42; and the conduit 46 in downstream communication with hydrocracking unit 44. The conduit 46 may be in direct, upstream communication with the conduit 22. In another specific embodiment of the apparatus, the conduit 46 may be in direct, upstream communication with the conduit 26.

In yet another embodiment of the apparatus, the conduit 48 is in downstream communication with the column 50 and in downstream communication with the conduit 42 to the hydrocracking unit 44. As discussed above, a fraction of lubricant base stock is thus recycled through the conduit 48.

In another embodiment of the apparatus of the present invention, the apparatus comprises the conduit 62 in downstream communication with the source of a Fischer-Tropsch liquid 60; the second hydrotreating unit 64 in downstream communication with the conduit 62; the conduit 66 in downstream communication with the second hydrotreating unit 64; the second isomerization unit 70 in downstream communication with the conduit 66; and the conduit 72 in downstream communication with the second isomerization unit 70 and in upstream communication with the conduit 26.

In another embodiment of the apparatus of the present invention, the apparatus further comprises the conduit 54 which is in downstream communication with the conduit 46 and in upstream communication with the conduit 66.

In another embodiment of the apparatus of the present invention, the apparatus further comprises the conduit 40 which is in downstream communication with the outlet 36 of the fractionation column 30 and in upstream communication with the conduit 66.

In another embodiment of the apparatus, the apparatus comprises the source of Fischer-Tropsch wax 20 in upstream communication with the conduit 22; the first isomerization unit 24 in downstream communication with the conduit 22 and in upstream communication with the conduit 26; the fractionation column 30 in fluid downstream communication with the conduit 26; and the fractionation column 30 in upstream communication with the conduit 22 such that the first isomerization unit 24 receives a lubricant base stock fraction from the fractionation column 30. In one specific embodiment of the apparatus of the present invention, the hydrocracking unit 44 is in downstream communication with the fractionation column 30, and in upstream communication with the first isomerization unit 24.

SPECIFIC EMBODIMENTS

While the following is described in conjunction with specific embodiments, it will be understood that this description is intended to illustrate and not limit the scope of the preceding description and the appended claims.

A first embodiment of the invention is a process for converting Fischer-Tropsch liquids and waxes into lubricant base stock and/or transportation fuels, the process comprising (a) feeding a Fischer-Tropsch wax to a first isomerization unit to produce an isomerized Fischer-Tropsch wax product; (b) combining a Fischer-Tropsch liquid with the isomerized Fischer-Tropsch wax product to create a mixture of the Fischer-Tropsch liquid and the Fischer-Tropsch wax product; and (c) feeding the mixture to a fractionation column to separate the mixture into a lubricant base stock fraction and at least one transportation fuel fraction. An embodiment of the invention is one, any or all of prior embodiments in this paragraph up through the first embodiment in this paragraph wherein step (b) further comprises feeding the Fischer-Tropsch liquid to a hydrotreating unit before combining the hydrotreated Fischer-Tropsch liquid with the isomerized Fischer-Tropsch wax product to create the mixture of the hydrotreated Fischer-Tropsch liquid and the isomerized Fischer-Tropsch wax product. An embodiment of the invention is one, any or all of prior embodiments in this paragraph up through the first embodiment in this paragraph further comprising feeding the Fischer-Tropsch liquid to a second isomerization unit after feeding the Fischer-Tropsch liquid to the hydrotreating unit and the Fischer-Tropsch liquid is combined with the isomerized Fischer-Tropsch wax product to create the mixture of the isomerized Fischer-Tropsch liquid and the isomerized Fischer-Tropsch wax product. An embodiment of the invention is one, any or all of prior embodiments in this paragraph up through the first embodiment in this paragraph wherein step (c) further comprises separating the mixture into a second fraction of lubricant base stock and feeding the second fraction of lubricant base stock along with the mixture to fractionation column. An embodiment of the invention is one, any or all of prior embodiments in this paragraph up through the first embodiment in this paragraph further comprising feeding the second fraction of lubricant base stock to a hydrocracking unit before feeding the second fraction of lubricant base stock along with the mixture to the fractionation column. An embodiment of the invention is one, any or all of prior embodiments in this paragraph up through the first embodiment in this paragraph wherein the process further comprises recycling a portion of the hydrocracked second fraction of lubricant base stock for further hydrocracking. An embodiment of the invention is one, any or all of prior embodiments in this paragraph up through the first embodiment in this paragraph wherein the process further comprises feeding hydrocracked second fraction of lubricant base stock to the second isomerization unit along with the hydrotreated Fischer-Tropsch liquids. An embodiment of the invention is one, any or all of prior embodiments in this paragraph up through the first embodiment in this paragraph wherein step (c) further comprises separating the mixture into a second fraction of lubricant base stock and feeding the second fraction of lubricant base stock along with the Fischer-Tropsch wax to the first isomerization unit. An embodiment of the invention is one, any or all of prior embodiments in this paragraph up through the first embodiment in this paragraph wherein step (b) further comprises feeding the second fraction of lubricant base stock to a hydrocracking unit before feeding the second fraction of lubricant base stock along with the Fischer-Tropsch wax to the first isomerization unit. An embodiment of the invention is one, any or all of prior embodiments in this paragraph up through the first embodiment in this paragraph wherein step (c) further comprises feeding the at least one transportation fuel fraction to the second isomerization unit along with the hydrotreated Fischer-Tropsch liquids.

A second embodiment of the invention is an apparatus for converting a Fischer-Tropsch liquid and a Fischer-Tropsch wax into lubricant base stock and/or transportation fuels, the apparatus comprising a source of a Fischer-Tropsch wax in upstream communication with a first conduit; a first isomerization unit in downstream communication with the first conduit and in upstream communication with a second conduit; a fractionation column in downstream communication with the second conduit; and a source of a Fischer-Tropsch liquid in upstream communication with the second conduit. An embodiment of the invention is one, any or all of prior embodiments in this paragraph up through the second embodiment in this paragraph wherein the apparatus further comprises a hydrocracking unit in downstream communication with the fractionation column. An embodiment of the invention is one, any or all of prior embodiments in this paragraph up through the second embodiment in this paragraph wherein the hydrocracking unit is in upstream communication with the first isomerization unit. An embodiment of the invention is one, any or all of prior embodiments in this paragraph up through the second embodiment in this paragraph wherein the hydrocracking unit is also in upstream communication with the fractionation column. An embodiment of the invention is one, any or all of prior embodiments in this paragraph up through the second embodiment in this paragraph wherein the apparatus further comprises a recycle conduit in fluid communication with an outlet and an inlet of the hydrocracking unit. An embodiment of the invention is one, any or all of prior embodiments in this paragraph up through the second embodiment in this paragraph wherein the apparatus further comprises a hydrotreating unit in downstream communication with the source of the Fischer-Tropsch liquid; and a second isomerization unit in downstream communication with the hydrotreating unit, the second isomerization unit being in upstream communication with the second conduit. An embodiment of the invention is one, any or all of prior embodiments in this paragraph up through the second embodiment in this paragraph further comprising a hydrocracking unit in downstream communication with the fractionation column, wherein the hydrocracking unit is in upstream communication with the second isomerization unit. An embodiment of the invention is one, any or all of prior embodiments in this paragraph up through the second embodiment in this paragraph wherein the fractionation column is in upstream communication with the second isomerization unit.

A third embodiment of the invention is an apparatus for converting a Fischer-Tropsch wax into lubricant base stock and/or transportation fuels, the apparatus comprising a source of a Fischer-Tropsch wax; a first isomerization unit in downstream communication with the source of the Fischer-Tropsch wax; and a fractionation column in downstream communication with the first isomerization unit, wherein the first isomerization unit is in downstream communication with the fractionation column, the first isomerization unit receiving a lubricant base stock fraction from the fractionation column. An embodiment of the invention is one, any or all of prior embodiments in this paragraph up through the third embodiment in this paragraph wherein the apparatus further comprises a hydrocracking unit in downstream communication with the fractionation column, and in upstream communication with the first isomerization unit.

Although the invention has been described in considerable detail with reference to certain embodiments, one skilled in the art will appreciate that the present invention can be practiced by other than the described embodiments, which have been presented for purposes of illustration and not of limitation. Therefore, the scope of the appended claims should not be limited to the description of the embodiments contained herein.

The invention claimed is:

1. An apparatus for converting a Fischer-Tropsch liquid and a Fischer-Tropsch wax into lubricant base stock and/or transportation fuels, the apparatus comprising:

a source of a Fischer-Tropsch wax in upstream communication with a first conduit;

a first isomerization unit in downstream communication with the first conduit and in upstream communication with a second conduit;

a fractionation column in downstream communication with the second conduit;

a source of a Fischer-Tropsch liquid in upstream communication with the second conduit; and a hydrocracking unit in downstream communication with the fractionation column.

2. The apparatus of claim 1 wherein the hydrocracking unit is in upstream communication with the first isomerization unit.

3. The apparatus of claim 1 wherein the hydrocracking unit is also in upstream communication with the fractionation column.

4. The apparatus of claim 1 wherein the apparatus further comprises a recycle conduit in fluid communication with an outlet and an inlet of the hydrocracking unit.

5. The apparatus of claim 1 wherein the apparatus further comprises:

a hydrotreating unit in downstream communication with the source of the Fischer-Tropsch liquid; and a second isomerization unit in downstream communication with the hydrotreating unit, the second isomerization unit being in upstream communication with the second conduit.

6. The apparatus of claim 5 further comprising a hydrocracking unit in downstream communication with the fractionation column, wherein the hydrocracking unit is in upstream communication with the second isomerization unit.

7. The apparatus of claim 5 wherein the fractionation column is in upstream communication with the second isomerization unit.

* * * * *